United States Patent [19]

Winslow et al.

[11] 4,161,408

[45] Jul. 17, 1979

[54] METHOD FOR THE PREPARATION OF A PHOTOTHERMOGRAPHIC SYSTEM

[75] Inventors: John M. Winslow, South St. Paul; Ivan R. Maw, Woodbury, both of Minn.

[73] Assignee: Minnesota Mining and Manufacturing Company, St. Paul, Minn.

[21] Appl. No.: 803,549

[22] Filed: Jun. 6, 1977

[51] Int. Cl.[2] ..... G03C 1/02; G03C 1/72

[52] U.S. Cl. ..... 96/114.1; 96/94 R; 96/114.6

[58] Field of Search ..... 96/114.1, 114.6, 94 R, 96/48 HD, 114.5

[56] References Cited

U.S. PATENT DOCUMENTS

| | | | |
|---|---|---|---|
| 3,152,904 | 10/1964 | Sorensen et al. | 96/114.1 |
| 3,457,075 | 7/1969 | Morgan et al. | 96/48 HD |
| 3,516,833 | 6/1970 | Hagge et al. | 96/114.5 |
| 3,539,352 | 11/1970 | Knox, Jr. | 96/114.5 |
| 3,549,379 | 12/1970 | Hellings et al. | 96/114.1 |
| 3,765,897 | 10/1973 | Nittel | 96/114.5 |
| 3,785,830 | 1/1974 | Sullivan et al. | 96/114.6 |
| 3,794,488 | 2/1974 | Henn et al. | 96/114.1 |
| 3,839,049 | 10/1974 | Simons | 96/114.6 |
| 4,003,749 | 1/1977 | Masuda | 96/114.1 |

OTHER PUBLICATIONS

Zelikman et al., Making & Coating Photographic Emulsions, Focal Press, N.Y., ©1964, pp. 233, 141, 142.

*Primary Examiner*—J. Travis Brown
*Assistant Examiner*—Louis Falasco
*Attorney, Agent, or Firm*—Cruzan Alexander; Donald M. Sell; Mark A. Litman

[57] ABSTRACT

A process of forming photothermographic emulsions which comprises adding silver halide with agitation to a dispersion of melted long chain fatty acid in water in the absence of alkali and ammonia salts of said acid, then converting the acid to an ammonia salt or alkali metal salt, then cooling the dispersion, and thereafter converting the alkali metal salt or ammonia salt to a silver salt of the acid.

8 Claims, No Drawings

METHOD FOR THE PREPARATION OF A PHOTOTHERMOGRAPHIC SYSTEM

Silver salts of fatty acids are used in the production of thermographic and photothermographic imaging materials. These salts are reduced to provide silver which is the substance of the image produced in these materials.

In the formation of photothermographic imaging materials, photosensitive silver halide salts have been combined with the substantially light-insensitive silver salts. The silver halide forms silver when struck with light, and this silver is catalytic to the reduction of the silver salts. Silver halide generally has been placed in catalytic proximity to the silver salts of fatty acids by physical admixture of the halide salt and organic salt (e.g., U.S. Pat. No. 3,152,904), mixture of preformed silver halide into the precipitating solution for the organic silver salt (e.g., U.S. Pat. No. 3,839,049) and in situ halidization of the dried or coated silver salt of fatty acids (e.g., U.S. Pat. No. 3,457,075).

All of these various methods for producing photothermographic materials require the same materials to be present in the structure and may use the same addenda for modification of sensitometric properties. The required material, in addition to the silver halide in catalytic proximity to the silver salt of an organic fatty acid, is the reducing agent for silver ions. Organic reducing agents, particularly organic photographic developers such as hydroquinone, methyl gallate, catechol, phenylene diamine, p-aminophenol and phenidone are useful. The hindered phenol reducing agents are the most preferred. Amongst the addenda which may be used in the diverse photothermographic emulsions produced by these processes are toning agents (e.g., U.S. Pat. Nos. 3,392,020; 3,446,648; 3,667,958), sensitizers and sensitizing dyes (e.g., U.S. Pat. Nos. 3,679,422; 3,666,477; 3,761,279; 3,719,495), color couplers (e.g., U.S. Pat. No. 3,531,286), decolorizable light absorbers (e.g., U.S. Pat. No. 3,745,009), mercury compounds (e.g., U.S. Pat. No. 3,589,903), etc.

SUMMARY OF THE INVENTION

The present invention relates to a novel process for manufacturing photothermographic sheets using preformed silver halide crystals.

The process described in U.S. Pat. No. 3,839,049 appears to require both an alkali containing environment (either ammonia or alkali metal) and formation of the ammonia or alkali salt of behenic acid prior to addition of the light sensitive silver halide because it is stated that behenic acid compositions with less than 35% of the acid present as salts do not form stable colloidal dispersions. The present invention has found a way of making such emulsions without the need for first converting the behenic acid to at least a 35% salt solution and does not require the alkali environment shown in the example of U.S. Pat. No. 3,839,049 when preformed silver halide is used.

More particularly, the present invention has found that by forming a colloidal dispersion of melted behenic acid in water, then adding silver halide to this dispersion, a stable dispersion of an admixture of behenic acid and silver halide is formed. This admixture may have the behenic acid converted to the ammonia or alkali metal salt of the acid and then the salt converted to silver behenate (as a partial or half soap with 50% converted to silver behenate or a full soap with 100% conversion) to form the light sensitive photothermographic emulsion material. The dispersion may be cooled prior to the conversion of the acid to the salt, but this is not preferred.

The colloidal dispersion of water and fatty acid is obtained by keeping the acid melted but not boiling in water and vigorously agitating the mixture to keep the acid in small droplets. The silver halide may be added to this dispersion to form the admixture of the acid and silver halide either by adding preformed silver halide grains to the dispersion while it is being agitated or by precipitating silver halide within the dispersion by jetting in silver nitrate and halide salts according to standard photographic chemistry techniques for forming silver halide emulsions. The addition of the silver halide must be done while the acid is dispersed, requiring both elevated temperature (between the melting point and boiling point of the acid) and vigorous agitation.

It is recognized in the light sensitive silver halide art that formation of grains at an elevated pH and in the presence of ammonia or alkali metals is conducive to the formation of fog centers in the grains. The present process, by adding the silver halide grains to the dispersion before conversion of the acid to an ammonia or alkali metal salt at elevated pH, as required in U.S. Pat. No. 3,839,049, avoids that potential for generated undesirable fog centers in the emulsion. The silver halide grains of the present emulsions when formed in the behenic acid dispersion may be formed in an environment which is acidic and in which the only ammonia and alkali metals would be those added in the step of silver halide precipitation, exactly as is done in conventional photographic silver halide manufacture.

Fatty acids as used in the practice of the present invention are long chain ($C_8$–$C_{28}$) alkyl groups with a terminal carboxylic acid group. More than one acid may be present, and $C_{14}$–$C_{24}$ acids are preferred. Systems comprising at least 40% by weight behenic acid are most preferred.

Any light sensitized silver halide grain may be used in the present invention, the selection of grains being chosen on the basis of known sensitivities and properties of the various grains. Silver chloride, silver bromide, silver iodobromide, silver iodochlorobromide emulsions, and any other known and photographically useful combinations of halide salts of silver may be used. Chemical sensitization with metal salts and sulfur containing compounds may also be used.

One of the conventional methods of converting the acid to the ammonia or alkali metal salt and then to the silver salt is that presently used in the photothermographic and thermographic art, except that the silver halide is already present. For example, sodium hydroxide is first added to the acid to form the sodium salt thereof, then silver nitrate is added to the sodium salt to generate the silver salt of the acid. The first step is done while the materials are maintained in a dispersion by heating and agitation. The conversion to the silver salt of behenic acid preferably takes place when the dispersion has been cooled.

The silver halide is useful in concentrations of from 0.25 to 75% by weight of total silver, but preferably is used in amounts of 1 to 50% and most preferably from 2 to 25% by weight of total silver in the emulsion.

A more detailed understanding of the present invention can be obtained by reading the following examples.

EXAMPLE 1

80 grams of behenic acid was heated in 2000 milliliters of water to 80° C. The mixture was then stirred vigorously to form fine droplets of the acid dispersed in the water. 13 grams of fine silver iodobromide crystals were added as a gelatin emulsion dispersed in water at 45° C. with 700 grams of gelatin emulsion per mole of silver and about 30 grams of gelatin per mole of silver, the crystals having a cubic structure and approximately 0.08–0.12 microns average edge length. The melted behenic acid-silver iodobromide mixture was thoroughly agitated and 0.5 milliliters concentrated nitric acid was added. 9.2 grams of NaOH in 0.50 liters of water was added then cooled to 45°–50° C. with continued vigorous agitation. A stable colloidal dispersion was formed. 39.5 grams of silver nitrate in 0.40 liters of water was added to this dispersion and the mixture heated at 50° C. for twenty-four hours with mild agitation. The mixture was filtered and washed two times with water and dried for 7 days at 32° C., yielding 105 grams of a fine yellowish-white powder.

An homogenate of this silver behenate-silver iodobromide admixture was made with 12 parts by weight admixture, 60 parts by weight methylethyl ketone, 21.7 parts by weight toluene, and 6.3 parts by weight methylisobutyl ketone.

200 grams of this homogenate was mixed in the dark with 16 grams of methylethyl ketone and 21 grams polyvinyl butyral resin. 0.10 g of $HgBr_2$ was added from a solution of 10 g $HgBr_2$/100 ml methanol. 5.6 grams of 1,1[bis(2'-hydroxy-3',5'-dimethylphenyl-3,5,5-trimethyl hexane)] developer and 2.0 grams of phthalazinone toner were added along with 0.063 g $ZnBr_2$ as a 6.3 g $ZnBr_2$/100 ml methanol solution. The mixture was stirred until the additional solids dissolved. This solution was then coated at 4½ mils wet thickness on a polyethyleneterephthalate surface and dried for 3 minutes at 88° C. A second coating of 160.8 grams methylethyl ketone, 81.8 grams toluene, 48.8 grams methanol and 8.6 grams of a (50/50) polyvinyl acetate/vinyl chloride copolymer was applied at 2 mils wet thickness and dried for 3 minutes at 88° C.

The photothermographic sheet was exposed in a sensitometer to 1000 meter candle seconds for 7.98 seconds through a filter simulating daylight exposure (5900 Corning Filter) through a 0–4 continuous wedge, then developed for 30 seconds at 126° C. The resulting image had a Dmax of 3.4 and a Dmin of 0.20.

EXAMPLE 2

1.3 grams of photographic gelatin was added to 2 liters of water and allowed to swell for 45 minutes. 0.5 grams of 2-ethylimidazole were added to improve the contrast and the mixture was heated to 80° C. with agitation. 80 grams of behenic acid and 0.5 ml concentrated nitric acid in 5 ml water were added. 2.01 grams $CdBr_2$ and 3.22 grams $NH_4Br$ in 0.2 liters of water were added to the heated mixture. 8.94 grams $AgNO_3$ dissolved in 0.20 liters of water was added to the acid-halide mixture with continuous stirring. 2.5 grams LiOH and 7.2 grams NaOH in 0.60 liters of water was then added to the silver halide-behenic acid mix, then cooled to 35° C. 0.89 grams $CdI_2$ dissolved in 0.10 liters of water was then added to the mix and then 39.5 grams $AgNO_3$ in 0.40 liters of water added to the mixture. This was dried for 7 days at 32° C. after washed twice with water. A yellowish white powder resulted.

An homogenate was made from this powder from 12 parts by weight powder, 60 parts by weight methylethyl ketone and 28 parts by weight toluene.

200 grams of the homogenate was mixed with 23 grams of polyvinylbutyral and 2 milliliters of a solution of 10% by weight $HgBr_2$ in methanol (as antifoggant). This solution was coated at 6 mils wet thickness on polyethyleneterephthalate base and dried for 3 minutes at 88° C.

A second coating composition was formulated which comprised:

126 milliliters methylethyl ketone
63 milliliters methylcellulose
3 grams phthalazinone (toner)
8.5 grams 1,1[bis(2'-hydroxy-3',5'-dimethylphenyl-3,5,5-trimethyl hexane)] (developer)
0.08 grams phthalic acid
5 grams (50/50) copolymer of vinyl acetate/vinyl chloride. This composition was coated over the first dried coating at 3½ mils wet thickness and dried for 3 minutes at 88° C.

The photothermographic sheet was exposed to 1,000 meter-candle-seconds daylight radiation as previously described then developed for 90 seconds at 126° C. The Dmax was 2.6, Dmin 0.21, contrast 1.0 and the speed was approximately 1 ASA at 0.1 density of base plus fog.

EXAMPLE 3

Example 2 was repeated identically except that no 2-ethylimidazole was used in the first coating and the halide solution added to the gelatin-behenic acid-water mixture had 2.01 g $CdBr_2$, 3.38 g $NH_4Br$, and 0.48 g NaI.

After identical construction of the sheet, exposure and development, a Dmax of 1.70 was generated with a Dmin of 0.26.

What is claimed is:

1. A method of forming a photothermographic emulsion which comprises adding light sensitive silver halide grains with agitation to a dispersion of a long chain fatty acid in water, with no alkali or ammonia salt of said acid present in the dispersion while the acid is maintained above its melting point but below its boiling point, then converting the acid to an ammonia salt or alkali metal salt of the acid, then cooling the dispersion, and thereafter converting the alkali metal or ammonia salt to a silver salt of the acid.

2. The process of claim 1 wherein said long chain fatty acid comprises an alkyl group of 8 to 28 carbon atoms having a terminal carboxylic acid group.

3. The method of claim 1 wherein the silver halide grains are added to the dispersion by precipitation therein.

4. The method of claim 3 wherein the long chain fatty acid is comprised of fatty acids having 14 to 24 carbon atoms therein.

5. The method of claim 3 wherein the emulsion is then coated with an organic reducing agent for silver ions onto a substrate and dried at a temperature which will not develop the emulsion.

6. The method of claim 1 wherein the silver halide grains are added to the dispersion as preformed grains.

7. The method of claim 6 wherein the long chain fatty acid is comprised of fatty acids having 14 to 24 carbon atoms therein.

8. The method of claim 6 wherein the emulsion is then coated with an organic reducing agent for silver ions onto a substrate and dried at a temperature which will not develop the emulsion.

* * * * *